US011229818B2

(12) United States Patent
Urena

(10) Patent No.: US 11,229,818 B2
(45) Date of Patent: Jan. 25, 2022

(54) RESISTANCE DEVICE

(71) Applicant: Alfredo Lumbreras Urena, Salem, OR (US)

(72) Inventor: Alfredo Lumbreras Urena, Salem, OR (US)

( * ) Notice: Subject to any disclaimer, the term of this patent is extended or adjusted under 35 U.S.C. 154(b) by 0 days.

(21) Appl. No.: 17/041,416

(22) PCT Filed: Mar. 25, 2019

(86) PCT No.: PCT/US2019/023935
§ 371 (c)(1),
(2) Date: Sep. 24, 2020

(87) PCT Pub. No.: WO2019/191006
PCT Pub. Date: Oct. 3, 2019

(65) Prior Publication Data

US 2021/0113881 A1 Apr. 22, 2021

Related U.S. Application Data

(60) Provisional application No. 62/647,819, filed on Mar. 25, 2018.

(51) Int. Cl.
*A63B 21/06* (2006.01)
*A63B 21/00* (2006.01)
(Continued)

(52) U.S. Cl.
CPC ..... *A63B 21/0608* (2013.01); *A63B 21/023* (2013.01); *A63B 21/0435* (2013.01);
(Continued)

(58) Field of Classification Search
CPC ..... A63B 21/0608; A63B 21/4035; A63B 21/023; A63B 21/0435; A63B 21/0455;
(Continued)

(56) References Cited

U.S. PATENT DOCUMENTS 786,552 A * 4/1905 Duffner ..... A63B 21/023 607/78
3,550,312 A 12/1970 East
(Continued)

FOREIGN PATENT DOCUMENTS

GB 2390036 A 12/2003
WO 2013175546 A1 11/2013

OTHER PUBLICATIONS

The U.S Receiving Office of WIPO, International Search Report and Written Opinion of the International Searching Authority regarding PCT Application No. PCT/US2019/023935, dated May 24, 2019, 9 pages.

(Continued)

*Primary Examiner* — Jennifer Robertson
*Assistant Examiner* — Catrina A Letterman
(74) *Attorney, Agent, or Firm* — Kolisch Hartwell, P.C.

(57) ABSTRACT

A device and method may be provided including at least one handle and at least one anchor point. The device may be operable to provide a resistance to a user of the device who fixes the device using the anchor point and pulls on the handle. The device may include a casing; a center rod rotatable mounted in the casing; a cable wound around the center rod and coupled to the handle; and a mechanism mounted on the central rod. The mechanism may be responsive with a centrifugal force to movement of the cable to rotate the central rod. The mechanism may include an anchor coupled to the central rod, and at least one weight connected by a wire to a ring that is movable along the central rod against the resistance of a spring.

1 Claim, 4 Drawing Sheets

(51) Int. Cl.

| | |
|---|---|
| ***A63B 21/02*** | (2006.01) |
| ***A63B 21/04*** | (2006.01) |
| ***A63B 21/045*** | (2006.01) |
| ***A63B 21/072*** | (2006.01) |
| ***A63B 21/16*** | (2006.01) |

(52) U.S. Cl.
CPC ..... *A63B 21/0455* (2013.01); *A63B 21/153* (2013.01); *A63B 21/4035* (2015.10); *A63B 21/0724* (2013.01); *A63B 21/1681* (2013.01); *A63B 21/4009* (2015.10); *A63B 21/4015* (2015.10); *A63B 21/4019* (2015.10)

(58) Field of Classification Search
CPC ..... A63B 21/153; A63B 21/4009; A63B 21/4015; A63B 21/4019; A63B 21/0724; A63B 21/1681; A63B 2023/006; A63B 21/00185; A63B 21/068; A63B 23/035; A63B 23/03541; A63B 23/03583; A63B 21/222; A63B 2225/09; A63B 21/22; A63B 21/04; A63B 21/0442; A63B 21/045; A63B 67/16; A63B 67/165; A63B 2208/12; A63B 21/0004; A63B 21/00043; A63B 21/00196; A63B 21/012; A63B 21/015; A63B 21/018; A63B 21/022; A63B 21/025; A63B 21/0407; A63B 21/06; A63B 21/0601; A63B 21/0616; A63B 21/0617; A63B 21/0618; A63B 21/065; A63B 21/072–075; A63B 21/08; A63B 21/151–153; B66B 5/044; B66B 5/046; A63H 1/02; A63H 1/32; A63H 1/04; A63H 1/30
USPC ..... 446/246–250
See application file for complete search history.

(56) References Cited

U.S. PATENT DOCUMENTS

| | | | | |
|---|---|---|---|---|
| 6,461,276 | B1 * | 10/2002 | Yu | A61H 23/00 482/110 |
| 6,488,613 | B1 * | 12/2002 | Domenge | A63B 21/22 482/110 |
| 9,950,204 | B2 * | 4/2018 | Eisenblaetter | A63B 21/4043 |
| 2003/0100418 | A1 * | 5/2003 | Domenge | A63B 21/0608 482/148 |
| 2016/0339290 | A1 | 11/2016 | Eisenblaetter | |

OTHER PUBLICATIONS

U.S. Receiving Office, International Preliminary Report on Patentability in International Patent Application No. PCT/US2019/023935, dated Oct. 8, 2020, 5 pages.

* cited by examiner

RESISTANCE DEVICE

RELATED APPLICATIONS

This application is a 371 National Stage Patent Application claiming priority to International Patent Application No. PCT/US2019/023935, filed Mar. 25, 2019, which claims the benefit of U.S. Provisional Patent Application No. 62/647,819, filed Mar. 25, 2018, which applications are incorporated herein by reference in their entirety for all purposes.

FIELD

This disclosure relates to devices providing a resistance to movement of a handle. More specifically, the disclosed embodiments relate to devices and methods for providing an exercise device with a base coupled by one or more cables to one or more handles that controllably resist extension of the handle away from the base.

INTRODUCTION

A machine may be used in an exercise machine by providing handles that are grippable and movable by a user. The machine may provide resistance against movement of the handles, thus requiring the user to apply force to move the handles to to overcome the resistance. Such a machine may provide resistance by use of heavy weights, which may be impractical and dangerous. Other exercise machines rely on friction knobs, belts, pulleys, flywheels and clutches for resistance and adjustment. Such machines typically are still too bulky and weigh too much to be considered for use in compact and mobile devices.

An improved mechanism recognizes these drawbacks and eliminates them by allowing the user to control starting resistance and allowing for control of resistance with his or her body. Furthermore, safety may be enhanced by the reduced weight versus traditional weight lifting sets. An improved centrifuge resistance machine may eliminate parts and control orbits of the rotating portion of the mechanism, so that much of the weight, bulk, and space necessary to operate is reduced resulting in a gain of mobility and ability to use in different directions.

SUMMARY

The present disclosure provides methods and devices for an improved device for providing resistance in an exercise machine.

Features, functions, and advantages may be achieved independently in various embodiments of the present disclosure, or may be combined in yet other embodiments, further details of which can be seen with reference to the following description and drawings.

DESCRIPTION

Various embodiments of methods and devices for providing resistance in an exercise routine are described below and illustrated in the associated drawings. Unless otherwise specified, the methods and devices and/or their various constituent pieces may, but are not required to, contain at least one of the structure, components, functionality, and/or variations described, illustrated, and/or incorporated herein. Furthermore, the structures, components, functionalities, and/or variations described, illustrated, and/or incorporated herein in connection with the present teachings may, but are not required to, be included in other similar embodiments, such as those for preparing and assembling the materials using the nondestructive inspection data. The following description of various embodiments is merely exemplary in nature and is in no way intended to limit the disclosure, its application, or uses. Additionally, the advantages provided by the embodiments, as described below, are illustrative in nature and not all embodiments provide the same advantages or the same degree of advantages.

Embodiments of the present disclosure may improve and streamline the construction and use of an exercise device.

Figure 2:
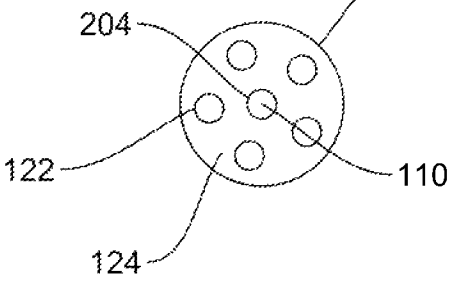
FIG. 2 is a top view of the anchor of FIG. 1, showing a hole for attachment to the central rod and holes to guide wires coupling the weights to the central rod.
Figure 1:
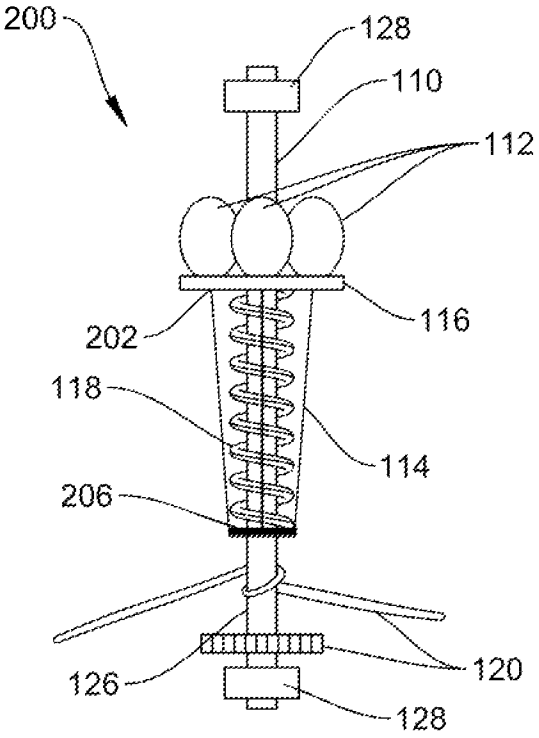
FIG. 1 is a front view of an internal mechanism of a resistance device, including a cable coupled to a central rod and a rotatable mechanism mounted on the central rod, the rotatable mechanism responsive with a centrifugal force to movement of the cable to rotate the central rod, the rotatable mechanism including an anchor coupled to the central rod, and weights connected by wires to a ring that is movable along the central rod against the resistance of a spring.

FIGS. 1 and 2 illustrate an internal mechanism, indicated generally at 200, for a resistance device (see FIGS. 4-6), which may include a responsive centrifugal embodiment constructed as a one piece unit that may be adapted for multiple different resistance devices. An anchor 202 may include a plate, such as guide 116, which may also serving as a stop anchor for a control spring 118. Guide 116 is typically affixed at a center hole 204 to center rod 110 so that guide 116 rotates with center rod 110. Guide 116 may be centrally and perpendicularly attached in a strategic location to the center rod 110. The top of the control spring 118 may be attached to the center rod 110 and used as an anchor with guides 116. A flexible non-stretching device 114, for example a thin steel wire, may attached to at least one centrifugal weight 112 and threaded through a guide hole 122 then attached to a ring 206 at the bottom of the control spring 118, which may snuggly force the control spring 118 against the anchor with guides 116. A starting moment of inertia may be adjusted at this point depending on how tight the control spring 118 is compressed. Alternatively or additionally, resistance can be adjusted depending on a setting of tension of the control spring 118.

An energy transfer device 120 such as a cord or cable that is flexible but generally resistant to stretching may be wound tightly at least once around the center rod 110 and used to engage the responsive centrifugal embodiment. As shown in FIG. 1, cord 120 is wound in a central portion around rod 110 with each end of cord 120 free, which may allow the resistance device to be used in a bi-directional manner, with the user pulling on either end of cord 120. A suitable friction means, such as gnarled washer 126 can be used to ensure grip for the winding of cord 120 around rod 110. Other energy transfer devices 120 include but are not limited to: gears, chains, pulleys, spools and levers.

Figure 3:
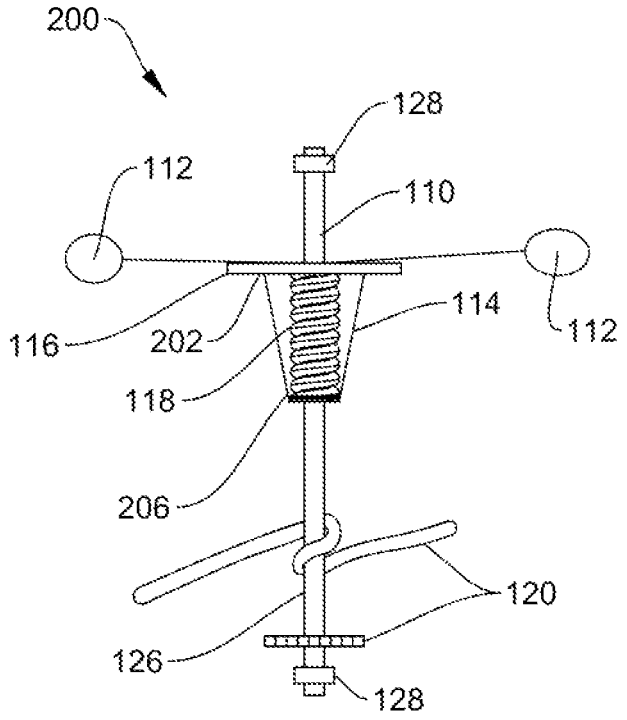
FIG. 3 is a front view of an internal mechanism as shown in FIG. 1, in this case with the cable moving to rotate the central rod about its axis, which in turn causes the weights to spin and move away from the central rod and to compress the spring as the weights, via the wires, move the ring along the central rod.

As a user engages the responsive centrifugal embodiment, such as that shown in FIGS. 1, 2, and 3, energy travels from a user through the energy transfer device rotating the center rod and sending at least one centrifugal weight into an orbit perpendicular to the center rod. Weights 112 in orbit are shown in FIG. 3 along with compression of spring 118 and movement of ring 206. Weight 112 typically starts from a point as close to the center of as feasible, with the planar surface guide 116 maintaining orbits in a perpendicular plane to the center rod, thus applying centrifugal force to the control spring and compressing it allowing for an expansion of orbits and increasing moment of inertia as more force is applied. It will be understood that the orbits will remain perpendicular to the center rod as the angle of use of the resistance device changes for use in mobile, non-stationary applications.

FIG. 3 shows full extension and a controlled orbit with two centrifugal weights 112. As applied force and/or momentum decrease the control spring expands thus applying centripetal force and contracting the centrifugal weight's orbit by pulling the tension control device through the guide hole drawing the centrifugal weight(s) back to center and transferring energy to the center rod and through the energy transfer device back to the user as resistance. Amount of resistance is controlled by the user by varying momentum and amount of force exerted or maintained.

Figure 4:
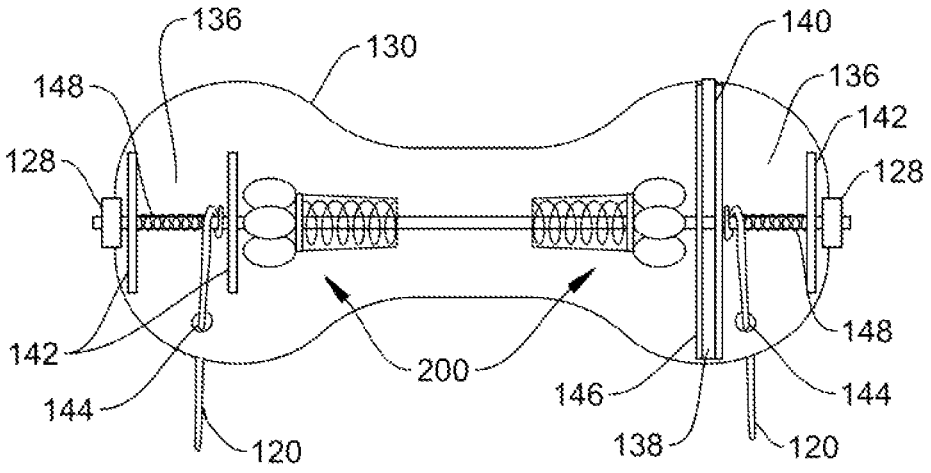
FIG. 4 is a resistance device similar to that for which the internal mechanism is depicted in FIG. 1 and in this case including two of the internal mechanisms, the device including an outer shell having a shape similar to a barbell or dumbbell, with the shell providing holes for cables connected to the internal, central rod to pass through for external operation by a user.

FIG. 4 is an illustration of the one-half of a barbell or dumbbell style casing 130 with the casing guide holes 144 housing two internal mechanisms 200 that provide responsive centrifugal embodiments, and any number of mechanisms may be installed in the resistance device. In this case two are sharing a center rod 110. In other embodiments, internal mechanisms may be independently placed in the casing 130. A built-in spool 136 may be created by attaching spool guides 142 or a spring and spool guide 140 to the center rod 110 leaving suitable space between the two to wind an energy transfer device 120 in this case two flexible non-stretch cords and two spools are being used although one cord 120 may be utilized for both spools 136.

Figure 5:
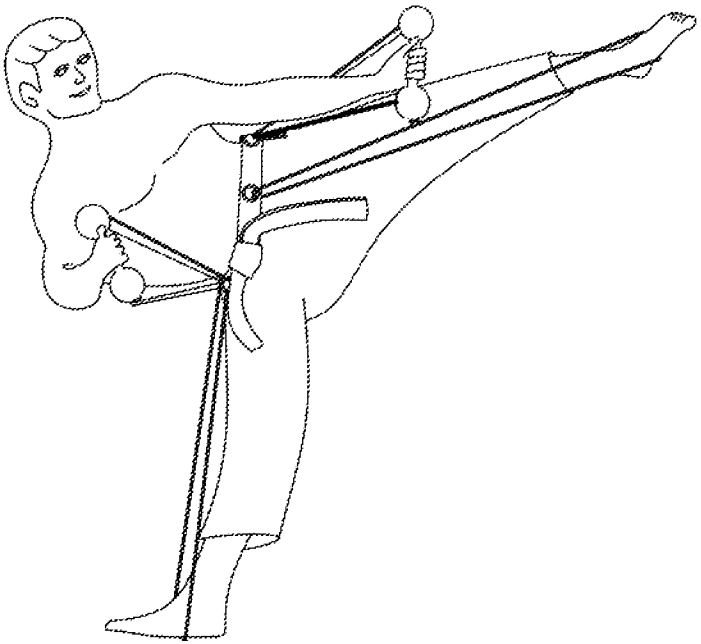
FIG. 5 is a user fitted with two of the embodiments depicted in FIG. 4.

One end of each cord 120 may be secured by a means of attaching 148 to each built-in spool 136, and wound around tightly and synchronously to the center rod 110 enough times to at least accommodate a user's stretch such as in FIG. 5. A return spring 138 may be placed inside one end of the casing 130, typically perpendicular to the center rod, and may be attached by the inside end of the return spring to the center rod 110 and by the outer end of the return spring to a lip of casing 130, e.g., a lip or other abutment formed between two halves of casing 130.

Return spring guides 146 may be used to keep the return spring 138 in place. A bearing 128 may be placed at each end of the center rod 110 and secured centrally to each end of the casing 130. The cords 120 may be threaded through strategically placed casing guide holes 144 and attached to the user. Controlling the width of the cord 120 allows said width to increase or decrease the circumference, and to decrease or increase the leverage and number of turns per length of spool thus by drawing out a certain amount of the cord 120 or letting the return spring 138 wind the cord 120 around the center rod 110 will either decrease or increase the circumference of the built-in spool 136 thus introducing adjustable starting moment of inertia.

As a user engages the barbell embodiment of FIGS. 4 & 5 with an outward and stretching motion, the responsive centrifugal embodiment enables resistance in a oneway direction and is capable of being activated by leg, arm, or any combination. As momentum decreases, the responsive centrifugal embodiment returns stored energy through the center rod and energy transfer device, in this case a flexible non-stretch cord, back to the user. A return spring keeps the cord taut for a smooth transfer of energy to and from the user. Resistance can readily be increased or decreased by drawing out the cords or letting the return spring draw in the cord, changing the circumference of the spool, which may vary the amount of leverage.

Figure 6:
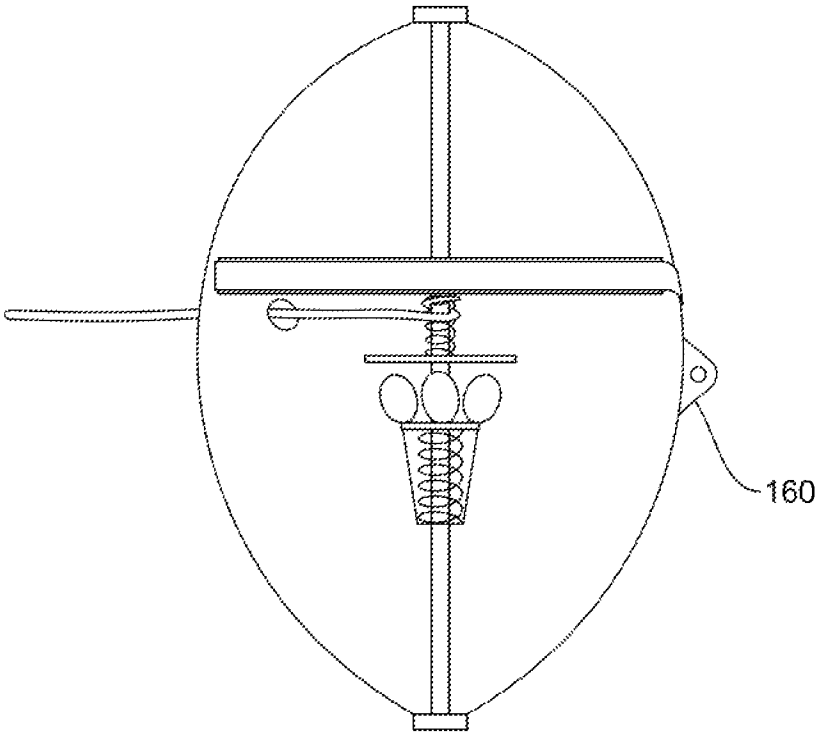
FIG. 6 is a front, cross-sectional view of another embodiment of a resistance device according to the present disclosure, in this case including an internal mechanism similar to that of FIGS. 1 and 4, and having an external outline that is roughly egg-shaped, and including a boss for anchoring the device.

FIG. 6 is the single-sided version, with the control spring 118, of the barbell embodiment in the form of a pod with a casing anchor 160. The pod version FIG. 6 of this embodiment is anchored to a stationary object with the user adjusting resistance by either drawing out the cord or letting the return spring wind up the cord then grasping or attaching the end of the cord to either his hand or foot or shoe or the object being swung and used to train certain muscles in a specific trajectory such as but not limited to swinging a bat, golf club, tennis racket, throwing a punch, kicking or running.

Figure 7:
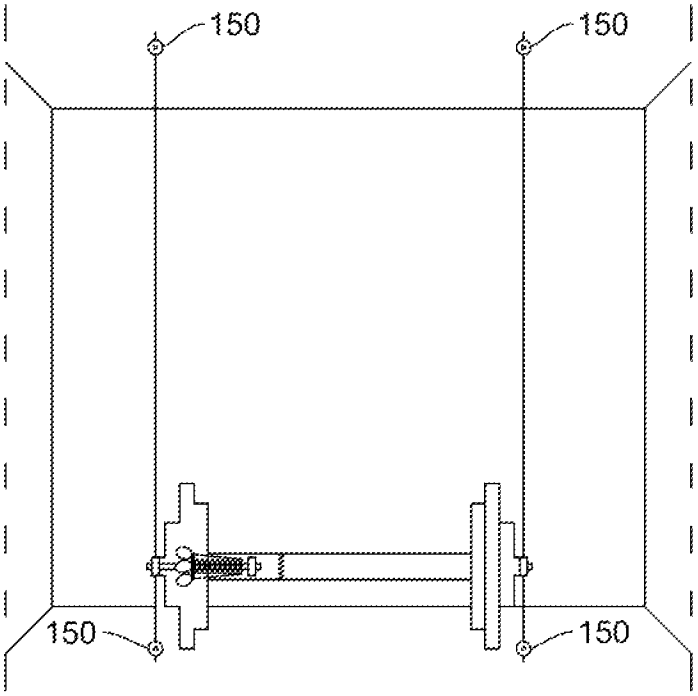
FIG. 7 is a front, partially cross-sectional view of another embodiment of a resistance device according to the present disclosure, in this case including a bi-directional capability and having an external configuration similar to a weight-lifting set with a barbell with a handle area in between ends with discs at each end, and including an internal mechanism similar to that of FIGS. 1, 4, and 6 shown in the partial cross-section, the resistance device including a pair of external couplers and associated wires anchored to the floor and to the ceiling of a room, in which the device is installed.

FIG. 7 illustrates the bi-directional embodiment with a casing 130 constructed as a replica of a weight lifting set, at least one responsive centrifugal embodiment is centrally and perpendicularly secured to at least one end of the casing 130. One end of an energy transfer device 120, in this case a flexible non-stretch cord, is secured by a means of anchoring 150 to the ceiling, the other end of the cord 120 is threaded through a casing guide hole 144 and wound at least once around the center rod 110 and through the opposing casing guide hole 144 then secured tightly to the floor with another means of anchoring 150, creating a bi-directional track on which to engage at least one responsive centrifugal embodiment.

As a user engages the bi-directional embodiment of FIG. 7 a simulation of weight is created by traveling along the track in an upward motion engaging the responsive centrifugal embodiment, upon full extension the user can train opposition muscles by changing directions and engaging the embodiment in a downward manner.

Other angles at which the embodiment is placed can be used to train different muscles. At any point the user can repeat to and fro motions to target muscles at a certain perimeter along the track.

A responsive centrifugal embodiment for use in exercise machines may include:

a. an energy transfer device used to transfer energy from a user and to and from said embodiment,
b. a center rod used for distributing rotational energy,
c. at least one centrifugal weight for inertia and means of storing kinetic energy,
d. a control spring used to regulate the flow of energy to and from at least one centrifugal weight and the center rod,
e. an anchor with guides as a means to strategically control orbits and a point from which to guide energy to and from the center rod and the centrifugal weight(s),
f. a guide hole as a means of controlling the point of distribution of energy to and from the center rod,
g. a planar surface as a means of controlling planar orbits for the centrifugal weight(s),
h. a flexible tension device transferring energy to and from at least one centrifugal weight and through the guide hole and to the unanchored end of the control spring introducing a variable means of resistance and return of energy, whereby as the user engages the responsive centrifugal embodiment producing rotational energy, moment of inertia is increased by expanding centrifugal orbits as more force is applied, then as momentum decreases, centripetal force is applied to return energy back to the user as resistance, most of the energy generated is returned to the user resulting in longer lasting embodiments from a lack of friction and introducing an interactive experience due to instant and incremental production of inertia and the return of kinetic energy depending on the force applied by the user, whereas most exercise machines rely on friction knobs, belts, pulleys, flywheels and clutches for resistance and adjustment, the responsive centrifugal embodiment eliminates these by allowing the user to control starting resistance and allowing for control of resistance with his or her body, other centrifuge resistance machines are bulky and weigh too much to be considered for use in compact and mobile devices, by eliminating parts and controlling orbits, much of the weight, bulk, and space necessary to operate is reduced resulting in a gain of mobility and ability to use in different directions.

The device may further include a casing made as a replica of a barbell or a pod, housing at least one responsive centrifugal embodiment with at least one built in spool and energy transfer device providing a means of adjusting resistance.

The device may further include a casing replicating a weight lifting set, producing variable and controlled resistance in a bi-directional manner, safety is enhanced by the reduced weight of the embodiment versus traditional weight lifting sets.

Figure 8:
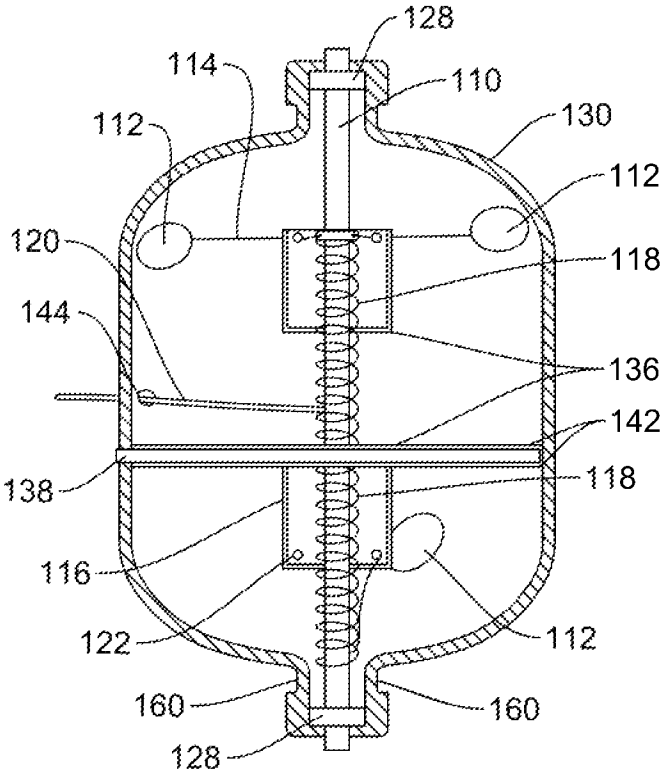
FIG. 8 is a front, cross-sectional view of another embodiment of a resistance device according to the present disclosure, in this case an external outline similar to that of FIG. 6, and including a pair of internal mechanisms similar to that of FIGS. 1, 4, and 6, in this case illustrating one of the pair of internal mechanism operating under force from the wire coupled to the central rod and the other pair of internal mechanisms at rest.

FIG. 8 illustrates a Modified Pod constructed with two responsive centrifugal embodiments. A casing 130 anchors two bearings 128 holding the center rod 110 and its workings at each end. An anchor with guides 116 is attached to the center rod 110 and in this case is constructed like a bell over the area of a control spring 118 that would be compressed fully. Then placing a control spring 118 around the center rod 110 and anchoring one end of the control spring 118 to the part of the anchor guides 116 that is attached to the center rod 110. At least one centrifugal weight 112 is attached to a flexible nonstretching device 114 in this case a thin steel cable which then is threaded through a guide hole 122 and attached to the freely moving end of the control spring 118. This is repeated on the upper side of the embodiment leaving a space between both anchor with guides 116 and creating a built-in spool 136 from which an energy transfer device 120 is wound around the center rod 110 and threaded out through a casing guide hole 144, a return spring 138 is used to rewind the energy transfer device 120.

The device as shown in FIG. 8 includes a bell shaped anchor with guides allowing natural movement and controlling the area of planar orbits of the centrifugal weights also controlling starting moment of inertia by moving the start position outward from the center.

As a user engages the cord and spins the center rod, centrifugal weights are sent into a controlled orbit by the action of the bottom of the control spring lining up to the guide holes and creating a swivel action as the centrifugal weight move out in orbit and lining up perpendicularly when fully extended. In this case can weights be added and the springs with different tension can be used. FIG. 8 illustrates a beginning position and a fully extended position to illustrate the swivel action.

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only, and do not constitute a characterization of any claimed invention. The subject matter of the invention(s) includes all novel and nonobvious combinations and subcombinations of the various elements, features, functions, and/or properties disclosed herein. The following claims particularly point out certain combinations and subcombinations regarded as novel and nonobvious. Invention(s) embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the invention(s) of the present disclosure.

I claim:

1. A device including at least one handle and at least one anchor point, the device providing resistance to a user of the device who fixes the device using the anchor point and pulls on the handle, the device comprising:

a. a casing;
b. a center rod rotatably mounted in the casing;
c. a cable wound around the center rod and coupled to the handle; and
d. a mechanism mounted on the central rod, the mechanism responsive with a centrifugal force to movement of the cable to rotate the central rod, the mechanism including an anchor coupled to the central rod, and at least one weight connected by a wire to a ring that is movable along the central rod against the resistance of a spring.

* * * * *